US007488177B2

(12) United States Patent
Pearson

(10) Patent No.: US 7,488,177 B2
(45) Date of Patent: Feb. 10, 2009

(54) BOARD SPORT SIMULATOR AND TRAINING DEVICE

(76) Inventor: Mike S. Pearson, 3660 E. Wormwood Ct., Boise, ID (US) 83716

( * ) Notice: Subject to any disclaimer, the term of this patent is extended or adjusted under 35 U.S.C. 154(b) by 547 days.

(21) Appl. No.: 11/373,231

(22) Filed: Mar. 10, 2006

(65) Prior Publication Data

US 2006/0217250 A1 Sep. 28, 2006

Related U.S. Application Data

(60) Provisional application No. 60/660,929, filed on Mar. 10, 2005.

(51) Int. Cl.
*G09B 19/00* (2006.01)

(52) U.S. Cl. ..... 434/247

(58) Field of Classification Search ..... 434/247, 434/255, 258; 463/36; 472/15, 16, 26, 135; 482/51, 70, 146
See application file for complete search history.

(56) References Cited

U.S. PATENT DOCUMENTS

| | | | |
|---|---|---|---|
| 2,714,007 | A | 7/1955 | Jordan |
| 2,764,411 | A | 9/1956 | Washburn, Jr. |
| 2,950,120 | A | 8/1960 | Stewart |
| 3,024,021 | A | 3/1962 | Coplin et al. |
| 3,269,746 | A | 8/1966 | Jonker |
| 3,488,049 | A | 1/1970 | Sasser, Jr. |
| 3,834,702 | A | 9/1974 | Bliss |
| 3,895,794 | A | 7/1975 | England |
| 4,408,613 | A | 10/1983 | Relyea |
| 4,505,477 | A | 3/1985 | Wilkinson |
| 4,512,567 | A | 4/1985 | Phillips |
| 4,607,839 | A | 8/1986 | Knudson |
| 4,711,447 | A | 12/1987 | Mansfield |
| 4,720,789 | A | 1/1988 | Hector et al. |
| 4,751,642 | A | 6/1988 | Silva et al. |
| 4,783,069 | A | 11/1988 | Cottee |
| 4,787,603 | A | 11/1988 | Norton |
| 4,817,950 | A | 4/1989 | Goo |
| 4,826,159 | A | 5/1989 | Hersey |
| 4,911,440 | A | 3/1990 | Hyman et al. |
| 4,966,364 | A | 10/1990 | Eggenberger |
| 5,049,079 | A | 9/1991 | Furtado et al. |
| 5,139,261 | A | 8/1992 | Openiano |
| 5,152,691 | A | 10/1992 | Moscarello |
| 5,190,506 | A | 3/1993 | Zubik et al. |
| 5,192,258 | A | 3/1993 | Keller |
| 5,195,746 | A | 3/1993 | Boyd et al. |
| 5,277,426 | A | 1/1994 | Gerpheide et al. |

(Continued)

*Primary Examiner*—Kurt Fernstrom
(74) *Attorney, Agent, or Firm*—Derek H. Maughan; Stephen M. Nipper; Dykas, Shaver & Nipper, LLP

(57) ABSTRACT

A balance board-training device made up of a training board, a pivoting device permanently connected to the underside of the training board and a rolling device that is configured and positioned so as to be able to roll across the underside of said training board. In use a rider stands on the upper side of the board or deck. As the rider moves, the one portion of the device pivots upon the dome shaped pivoting mechanism and the other end of the device moves and is able to move both side to side, as well as in a rising and falling motion as the rolling device of the present invention moves beneath the board.

19 Claims, 7 Drawing Sheets

U.S. PATENT DOCUMENTS

| | | | | |
|---|---|---|---|---|
| 5,277,678 | A | 1/1994 | Friedebach et al. | |
| 5,320,593 | A | 6/1994 | Heatwole | |
| 5,405,152 | A | 4/1995 | Katanics et al. | |
| 5,433,683 | A | 7/1995 | Stevens | |
| 5,462,503 | A | 10/1995 | Benjamin et al. | |
| 5,516,105 | A | 5/1996 | Eisenbrey et al. | |
| 5,545,115 | A | 8/1996 | Corcoran | |
| 5,584,787 | A | 12/1996 | Guidry | |
| 5,591,104 | A | 1/1997 | Andrus et al. | |
| 5,613,690 | A | 3/1997 | McShane et al. | |
| 5,645,513 | A | 7/1997 | Haydocy et al. | |
| 5,713,794 | A | 2/1998 | Shimojima et al. | |
| 5,745,055 | A | 4/1998 | Redlich et al. | |
| 5,860,861 | A | 1/1999 | Lipps et al. | |
| 6,017,297 | A | 1/2000 | Collins | |
| 6,022,272 | A | 2/2000 | Sano | |
| 6,139,473 | A | 10/2000 | Koyama et al. | |
| 6,543,769 | B1 | 4/2003 | Podoloff et al. | |
| 6,698,776 | B2 | 3/2004 | Todd | |
| 6,805,658 | B2 | 10/2004 | Desberg | |
| 6,924,487 | B2 * | 8/2005 | Bolozdynya et al. | 250/390.01 |
| 6,929,478 | B1 * | 8/2005 | Spencer et al. | 434/247 |
| 7,070,192 | B1 * | 7/2006 | Steiner | 280/87.042 |
| 7,247,026 | B1 * | 7/2007 | Ellis | 434/247 |
| 2003/0017922 | A1 | 1/2003 | Sachs | |
| 2003/0186785 | A1 | 10/2003 | Desberg et al. | |
| 2004/0023766 | A1 | 2/2004 | Slone | |
| 2004/0063556 | A1 | 4/2004 | Wischusen | |
| 2004/0138028 | A1 | 7/2004 | Hsieh | |
| 2004/0224824 | A1 | 11/2004 | Lickle | |

* cited by examiner

BOARD SPORT SIMULATOR AND TRAINING DEVICE

CROSS-REFERENCE TO RELATED APPLICATIONS

This application is a non-provisional application which claims the priority date from the previously filed provisional application entitled BOARD SPORT SIMULATOR filed by Mike Pearson on Mar. 10, 2005 with application Ser. No. 60/660,929, the disclosure of which is incorporated herein by reference.

FIELD OF THE INVENTION

The present invention generally relates to athletic training and sports performance enhancement devices, and more particularly to, a balance training and sports performance enhancing apparatus for use with board sports such as snow boarding, surfing, wakeboarding and the like, as well as a ski training device.

BACKGROUND OF THE INVENTION

In recent times, the popularity and number of participants in sports that require a rider to balance themselves upon a board has grown tremendously. Examples of such sports include surfing, skateboarding, snowboarding and wake boarding which require the placement of both feet upon a single board, as well as skiing which requires the placement of each foot upon individual board.

One problem, however, that exists with the participation in many of these sports is that these activities must often be performed in locations under conditions that are not easily reproducible in other locations. Hence, one's ability to master certain skills related to the use of one of these devices is limited. Another problem which exists is that in many instances multiple devices must be utilized to master skills related to both boarding activities as well as skiing activities.

What is needed therefore, is a training device that enables a person to practice various movements upon a board-training device while remaining in a generally stationary location and position. In the past, a variety of other devices have made attempts to simulate and recreate the feel of riding a board type of device. However, none of these devices have proven effective in one of these devices and none of these devices have provided a device that allows for some of the most basic moves to be simulated and recreated in a generally stationary practice location.

For example, the device described in U.S. Pat. No. 5,545,115 contains a singular elongated cylinder and is positioned beneath the platform of the device. This elongated cylinder rolls from one position to another along the bottom of the device. This device lacks the ability to properly simulate the movement and action of a device such as a snowboard or surfboard that does not have this longitudinally positioned wheel, and which is steered by shifting one's weight so as to allow the portion of the board near the back of the device to remain in one position, while the front of the device is swept in a direction which allows the direction of the turn to be selected.

Other types of training devices have also been invented that attempt to recreate the feel of a snowboard type of device. An example is described in U.S. Pat. No. 5,584,787. This device also includes a location and adaptation that allows the rotation and pivot of the board over a pair of points. However, this device also fails to provide a device that allows one end of the board to pivot over a point while the other end of the device swings in a generally semicircular path. This device particularly does not allow the user to point the front end of the device in a downward orientation while moving the front end of the device in a lateral direction to either the left or the right so as to simulate the sweeping movement that is required by the use of a snowboard, surfboard, skateboard, or the like in actual practice.

These aforementioned desired types of movements are the natural movements that are utilized by most board users so as to be able to control the rate of speed and the orientation of the board and its rider as they traverse a designated surface. None of the prior art devices describe a device that allows a user to practice such movements, or provide a training device that truly replicates the feel and movements that takes place when such a device is utilized on the actual desired sport surface.

The present invention has a design that provides a user with this ability to practice those techniques and train those particular muscle groups that will be utilized and implemented in the actions of riding and utilizing a surfboard, snowboard, skateboard, or other such similar device. The device of the present invention can be utilized indoors or outdoors and provides a variety of advantages to the user as a training and recreational device. This is due in part to the ability that a rider of this device has to sweep the front end while the rear portion pivots and rocks over a pivot point. In addition to this feature by reversing the orientation of the board from the orientation that is utilized in recreating boarding activities the present invention can also be utilized as a ski training device.

Additional objects, advantages and novel features of the invention will be set forth in part in the description that follows and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a combination balance training board, board sport training device, and ski training device that allows a party to improve their balance, muscular coordination and timing while simulating various maneuvers that are commonly performed in various sports.

In the preferred embodiment of the invention, described more fully hereinafter, the invention is comprised of three principal pieces: a board, a pivot point and a rolling device. While in this embodiment three key pieces are shown, it is to be understood that the invention is in no way limited to this description and that various additions to these pieces may be envisioned and included with the invention while remaining within the scope of the present claims.

The first of the pieces of the invention is a platform or board. This platform or board can be variously configured to have the general outer dimensions and configurations as are typically found in a particular board sport. The exact specification of the particular platform or board may be varied according to the particular needs and necessities of a user. In the preferred embodiment of the invention, the board is dimensioned so as to allow for placement of users' feet at approximately the same distance that these feet would be positioned when a rider is positioned upon a particular board device. In addition in the present preferred embodiment, the training board is made of wood and is covered with a textured silica or resin coating so as to provide a desired level of protection and tack to the board surface. In some embodiments of the invention, the position of the board as well as the other elements described herein, may be variously modified so as to allow the user to approximate the desired positioning and feel of a designated type of device.

Attached to the underside of the board, near the rear portion of the board, is a generally dome-shaped protrusion that serves as a pivot point. This pivot point allows a user to both pivot the front end of the device as well as rock the rear portion of the device in such a way so as to simulate the movement of a typical sport board in response to the movement of the user's weight upon such a device. This dome shaped protrusion allows the board to tilt and pivot in any one of a variety of directions at a particular time. In the preferred embodiment, this pivot point also contains a connection point for an arm that is connected to a wheel, which serves as a roller beneath the board-rolling device. The rolling of the roller together with the pivoting of the arm about a fixed point enables the first end of the board to be swept in a desired direction when in use. As is described more fully hereafter, in embodiments where the user is attempting to perform board sport maneuvers, this first end is located in front of the user. While in embodiments where the user is utilizing the device as a ski training device this first end is located in back of the user.

In one preferred embodiment of the invention, an elastic cord such as a bungee or spring is connected to the first, second or both the first and second ends of the training board. This cord is then connected to the wheel of the control arm and assists to hold the wheel and the control device in a desired position, orientation and alignment with the board itself.

In some embodiments, the underside of the board also contains a pair of stops positioned along the outer margins of the board. These stops prevent the wheel from rotating out of the designated path. In other embodiments, the connection between the roller and the board contains a separate stopping mechanism that controls the arc of the rotation of the wheel. In such embodiments, the placement of stops along the margins of the underside of the board is not necessary. In other embodiments, a protective track surface may be placed on the underside of the board so as to prevent damage to the underside of the board by the movement of the wheel across the underside of the board.

In use a rider stands on the upper side of the board or deck. As the rider shifts his weight the board engages in various movements. The second portion of the device pivots upon the dome shaped pivoting mechanism. As the second end of the device pivots around this pivot point, a roller that is positioned under the board rolls between the floor and the underside of the board itself. This causes the first portion of the board to be moved in both lateral and vertical directions. In addition to this use, when the device is oriented so that the user is positioned between the roller and the pivot point of the invention and is facing toward the second end of the device, the device can be utilized as a ski trainer wherein movements on the left leg force the device to move to the right, and movements of the right leg cause the device to move to the left.

This configuration provides a variety of advantages to a user. A user while standing on the top of the board facing the first end can shift his weight to swing the front end of the board in a variety of lateral directions by pivoting the board upon the rear pivot point. The weight of the rider causes the front end of the board to ride over the top of the wheel, and simulates the action and movements that a user would have to make to engage in turning a board upon a surface such as snow. To simulate a turn in the opposite direction, the rider can then shift their weight or press their feet in the opposite direction or on the other side of the board. By repeating and varying these movements, the coordination and balance required to control a surfboard, snowboard, skateboard, or the like, is approximated and improved. In addition to its use as a training device, the present invention may also be used as a recreational device in and of itself.

This device can be utilized either indoors or outdoors. Unlike other balance boards, the present invention allows the rider to actually turn the board using the same techniques used for turning snowboards, skateboards and surfboards. This invention allows a user to practice shifting their weight and controlling their bodies in a way that is substantially similar to the way that this is actually done in an actual situation. Thus, providing enhanced feel and providing greater and enhanced capabilities to the user.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention, which is measured by the claims, nor is it intended to be limiting as to the scope of the invention in any way.

Still other features and advantages of the present invention will become readily apparent to those skilled in this art from the following detailed description describing only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1A:
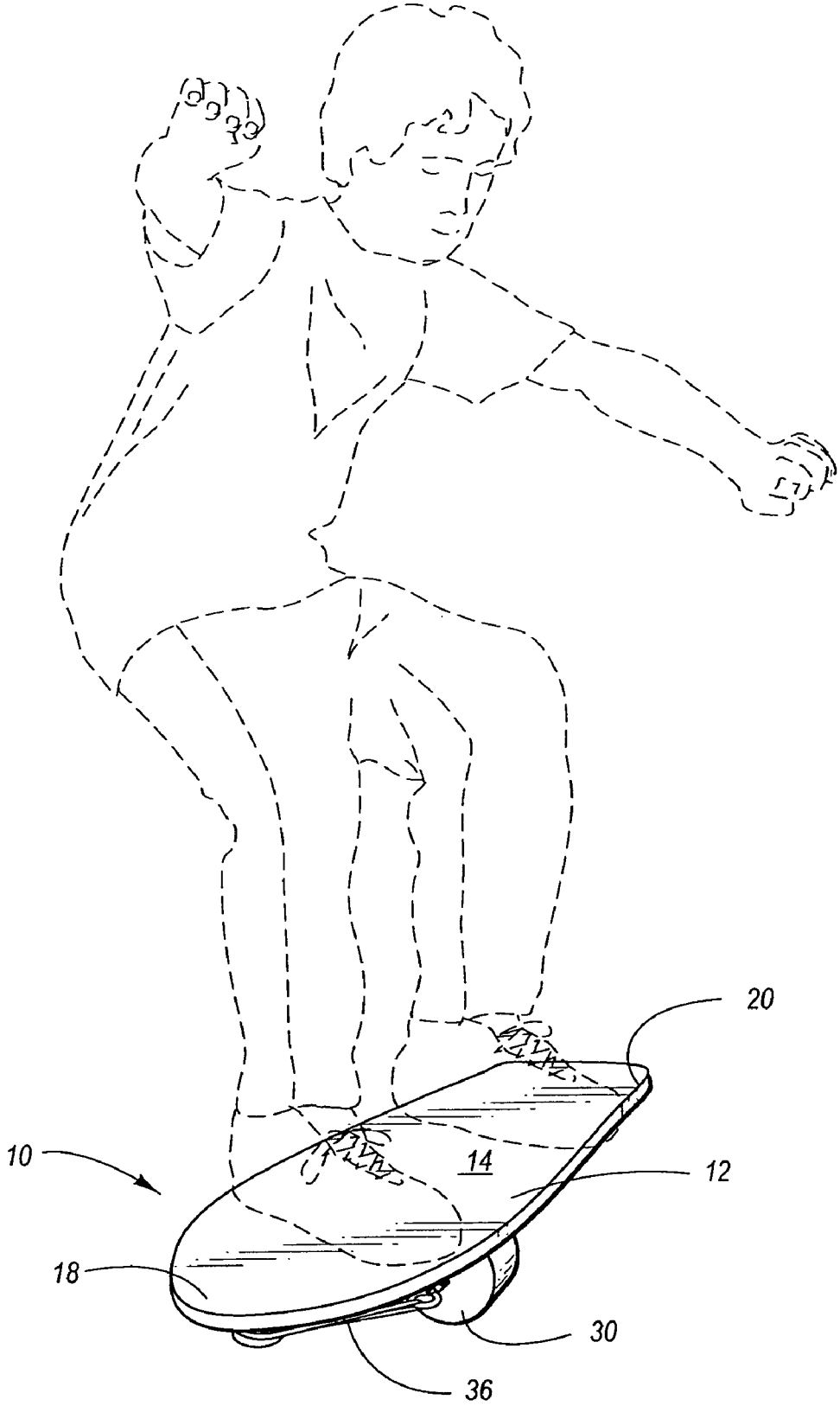
FIG. 1A shows an embodiment of the invention with a rider utilizing this inventions as a board sport training device

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the invention is to cover all modifications, alternative constructions, and equivalents falling within the spirit and scope of the invention as defined in the claims.

The present invention is a combination balance board and board sport training device that allows a party to improve their balance, muscular coordination and timing while simulating various maneuvers which are commonly performed in various board sports such as snow boarding, skateboarding, surfing and the like. The present invention more closely simulates the actual movements of a rider when placed upon a board and engaged in the actual activities such as snowboarding, surfing, skateboarding and the like. In addition, the device can be utilized as a recreational device in and of itself, as well as a ski training device.

Figure 1B:
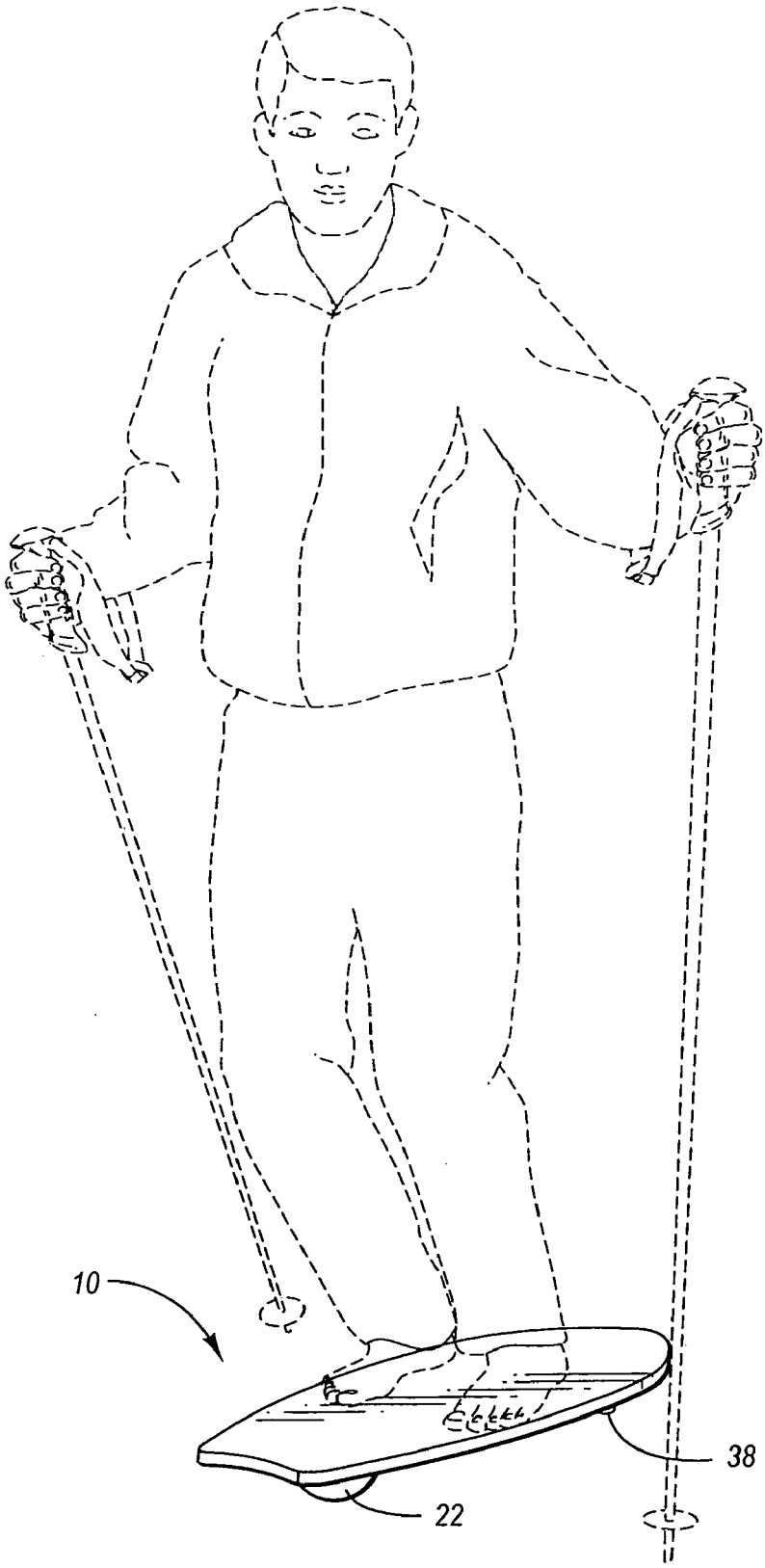
FIG. 1B shows an embodiment of the invention wherein a rider is utilizing the invention as a ski training device.

Various views of the preferred embodiments of the invention are set forth in the attached drawings 1-12 and are described hereinafter. FIGS. 1A and 1B show two uses of the invention by a typical rider. FIG. 1A shows one use of the invention by a typical rider. In this use, a rider places his feet upon the top surface 14 of the board 12 in a position wherein the feet of the rider are approximately shoulder width apart and directed generally perpendicular to the longitudinal orientation of the device. As the weight of the rider is placed upon the board 12, the board 12 will pivot and tilt as will be described in further detail hereafter. The rider can then vary the position and movement of the board 12 by appropriately shifting their weight so as to cause the board to move in a desired position and orientation.

In FIG. 1B of the application, this same device is used by a rider facing backwards upon the device with their feet approximately 10 inches apart and aligned in parallel with the longitudinal axis of the device. As the rider moves their body and shifts their weight upon the device, the board responds similar to the way that skis do for a skier when this skier is upon a ski slope. Namely, an increase of weight upon the left leg will cause the device to move to the right and an increase of weight upon the left leg will cause the device to move the right.

Figure 2:
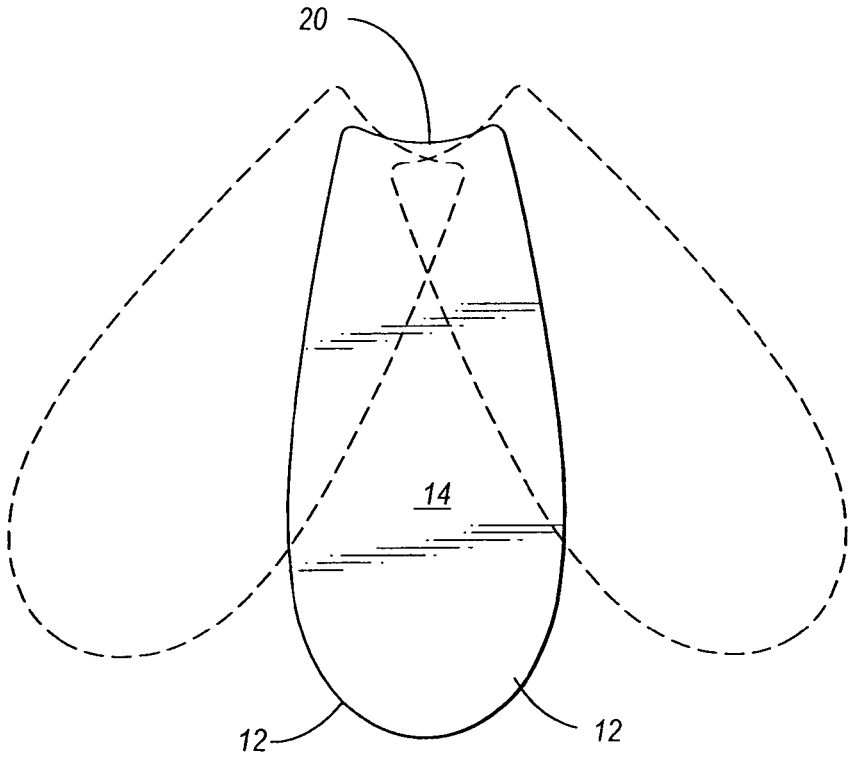
FIG. 2 shows the rotational movement of the board of the present invention over a particular pivot point.
Figure 3:
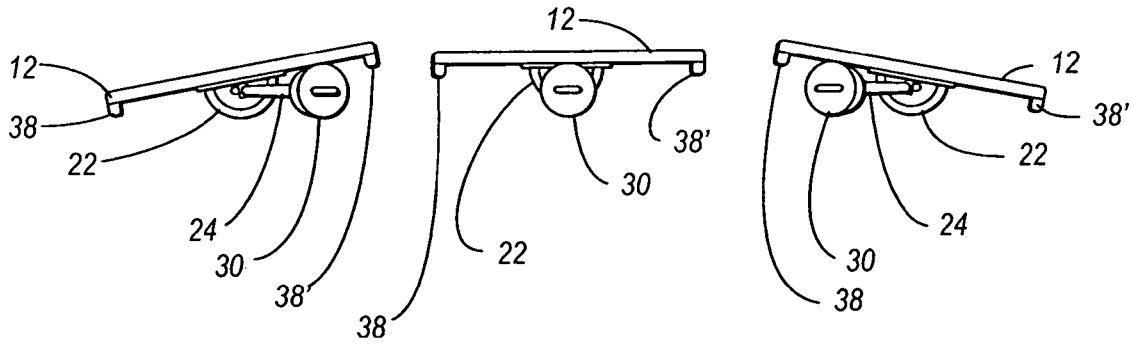
FIG. 3 of the present invention shows the movement of the board of the present invention over the wheel at the front portion of the device.
Figure 4:
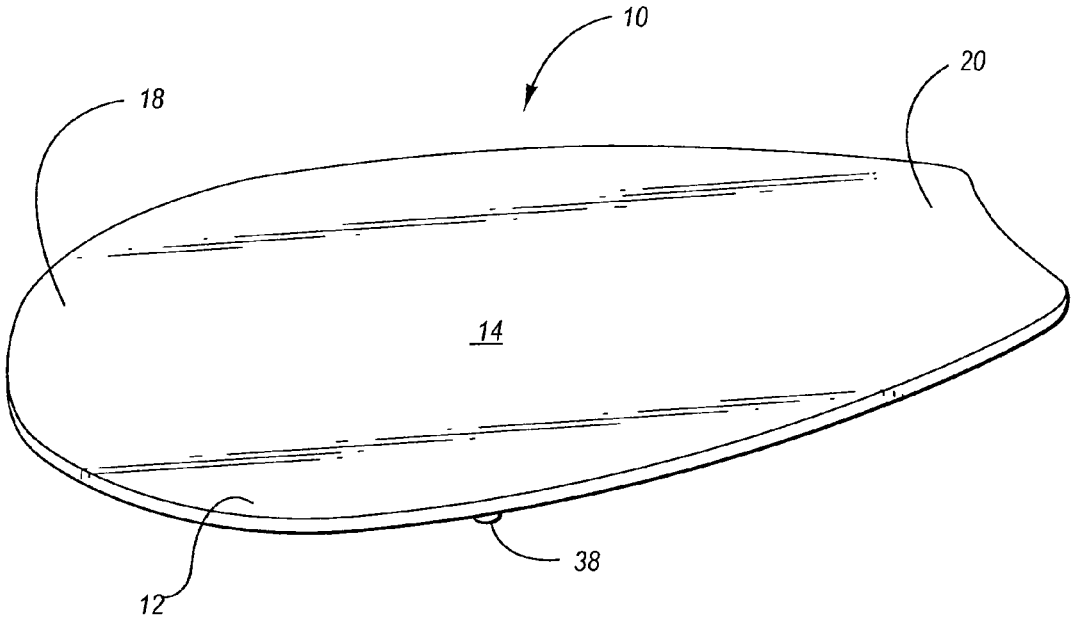
FIG. 4 shows a top view of a first embodiment of the invention.
Figure 5:
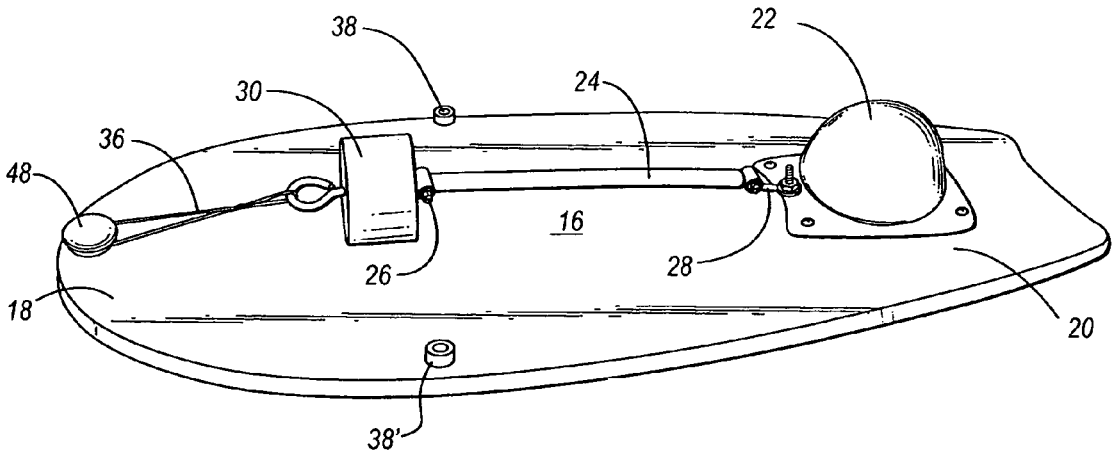
FIG. 5 shows a perspective bottom view of the embodiments shown in FIG. 4.
Figure 6:
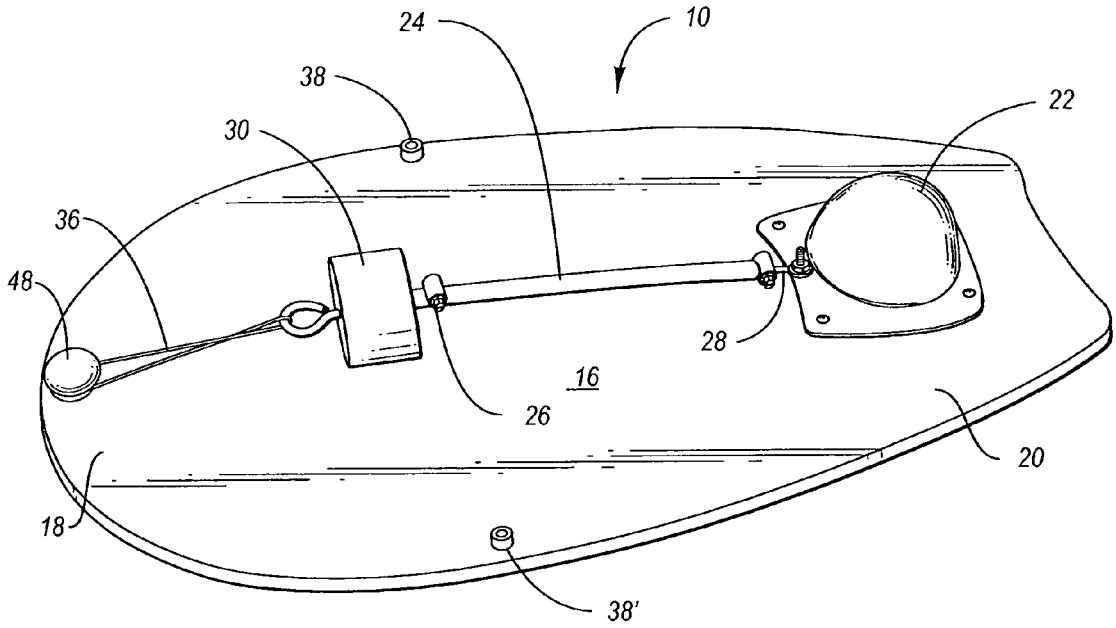
FIG. 6 shows an elevated bottom perspective view of the preferred embodiment of the invention shown in FIG. 5.
Figure 7:
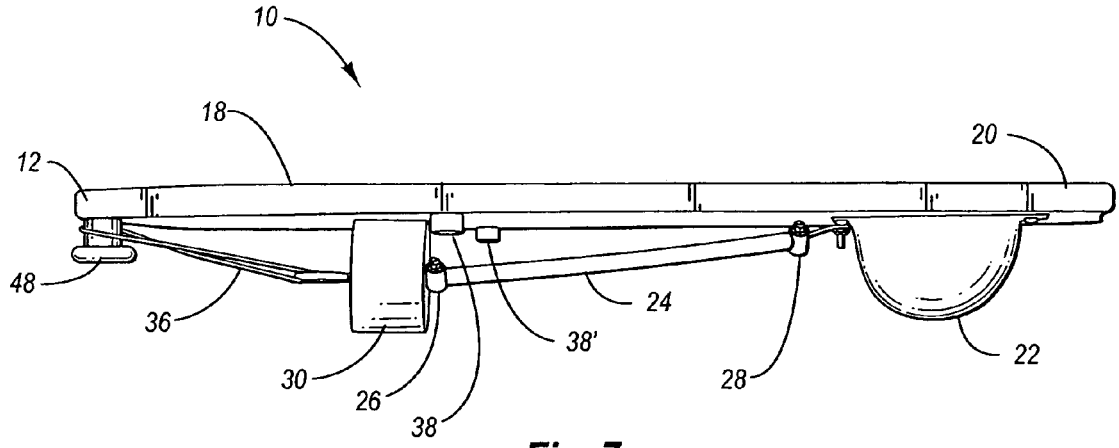
FIG. 7 shows a side view of the embodiment of the invention shown in FIG. 6.

In order to simulate the natural movements of various sporting devices, as they currently exist, the board of the present invention must be able to move in several different directions. As is shown in FIG. 2, the first portion of the device must be able to pivot or sweep about a pivot point 22 located near the rear 20 of the board 12. As is shown in FIG. 3, the top portion 14 or deck of the device 10 must also be able to rotate or pivot over a rolling device 30 that lies along a generally longitudinal axis. At times, all of these movements must take place simultaneously.

Referring now to FIGS. 4-7, various views of a first preferred embodiment of the invention are shown. In a first preferred embodiment of the invention, the invention 10 is comprised of a training board 12, which has an upside 14, an underside 16, a first end portion 18, and a second end portion 20. Attached to the underside 16 of the training board 12, is a pivoting device 22 and a wheel or rolling device 30 that is connected to a control arm 24. In the preferred embodiment of the invention, the pivoting device 22 is made from a hardened plastic that is formed in a generally dome-like shape. In some embodiments of the invention, this pivoting device 22 is generally hollow. In some embodiments of the invention, this pivoting device 22 may further define an aperture 42, which is utilized in some embodiments of the invention, such as those embodiments shown in FIGS. 8-12, to control the movement of the control arm 24, and thus, the arc that the wheel 30 will travel in.

This pivoting device 22 allows a user to both pivot the first end 18 of the device, as well as to rock the second end portion 20 of the device in such a way so as to simulate the movement of a typical sport board in response to the movement of the user's weight upon such a device 10. This pivoting device 22 allows the board to tilt and pivot in any one of a variety of directions at a particular time. In the preferred embodiment, this pivot point 22 also contains a connection device such as a bolt or other similar device that connects the control arm 24 of the device to the underside 16 of the training board 12.

In some embodiments, the underside 16 of the board 12 also contains a pair of stops 38,38' that are preferably positioned along the outer margins of the board. These stops 38,38' prevent the wheel or rolling device 30 from traveling outside of a designated path. In other embodiments of the invention, the connection between the control arm 24 and the training board 12 contains a separate stopping mechanism that controls the path in which the wheel 30 will travel. In some embodiments, a protective track 40 may be placed on the underside 16 of the board 12 so as to prevent damage to the underside of the board by the movement of the wheel 30.

The control arm 24 has a first end 26, which is connected to the wheel or rolling device 30, and a second end 28, which is connected to the underside 16 of the training board 12. The control arm 24 either by nature of the material from which it is made of, or by virtue of the connection between the underside 16 of the training board, is able to travel in a designated arc shaped path along the bottom surface of the board 12. In this first preferred embodiment of the invention, the wheel 30 is connected to a first end spring connection device 48 by an elastic cord, spring or bungee 36. This spring or bungee assists to return the wheel 30 to a desired position generally perpendicularly aligned with the longitudinal axis of the board.

Figure 8:
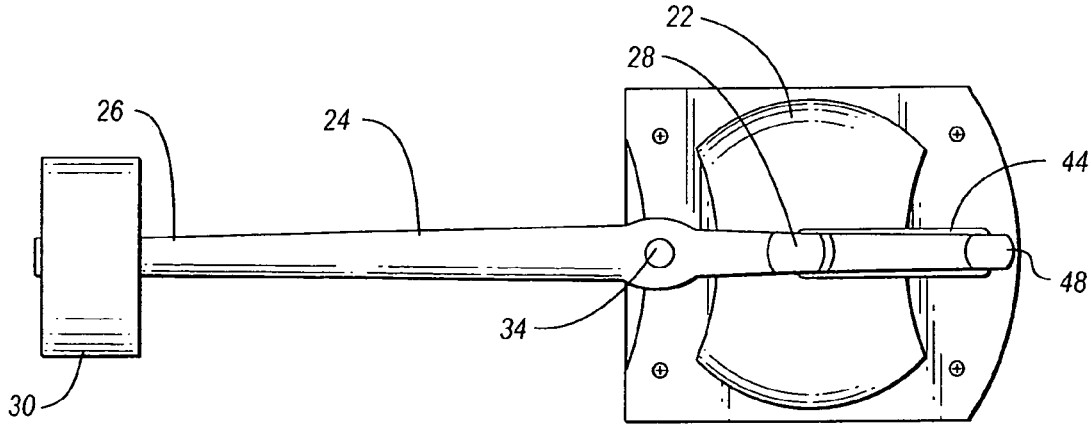
FIG. 8 shows a detailed top view of a connection device that is utilized in a preferred second embodiment of the invention.
Figure 9:
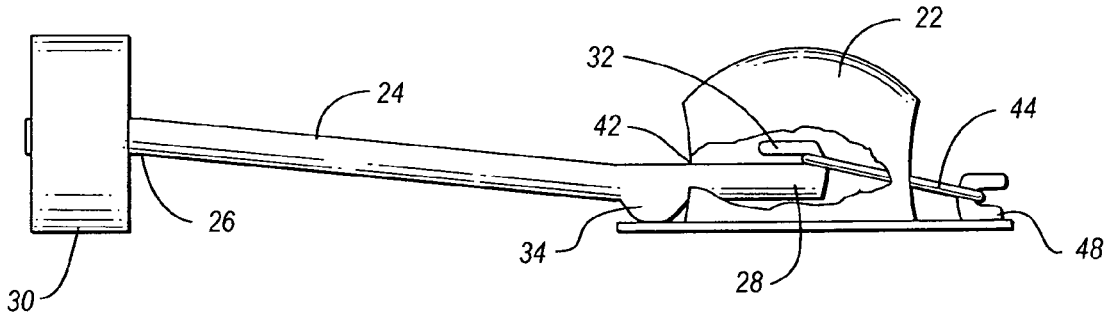
FIG. 9 shows a detailed side view of the connection device shown in FIG. 8.

In the second preferred embodiment of the invention shown in FIGS. 8 and 9, the control arm 24 also contains a control arm pivot point 34, which is pivotally connected to the underside 16 of the training board 12 and a connection portion 32, which is configured to interact with a flexible connection device 44 that is also an elastic cord, spring, bungee or other similar item. This flexible connection device 44 is connected to the rear portion 20 of the underside 16 of the board 12, through a second end spring connection device 48. In other embodiments of the invention, the control arm 24 may be held in a desired position and orientation by another type of clamp or connecting device.

Figure 10:
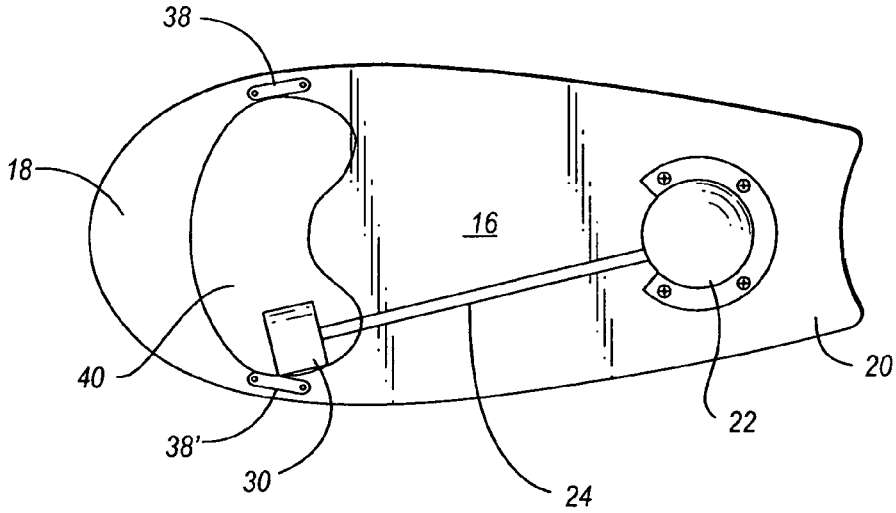
FIG. 10 shows a bottom view of a third preferred embodiment of the invention.
Figure 11:
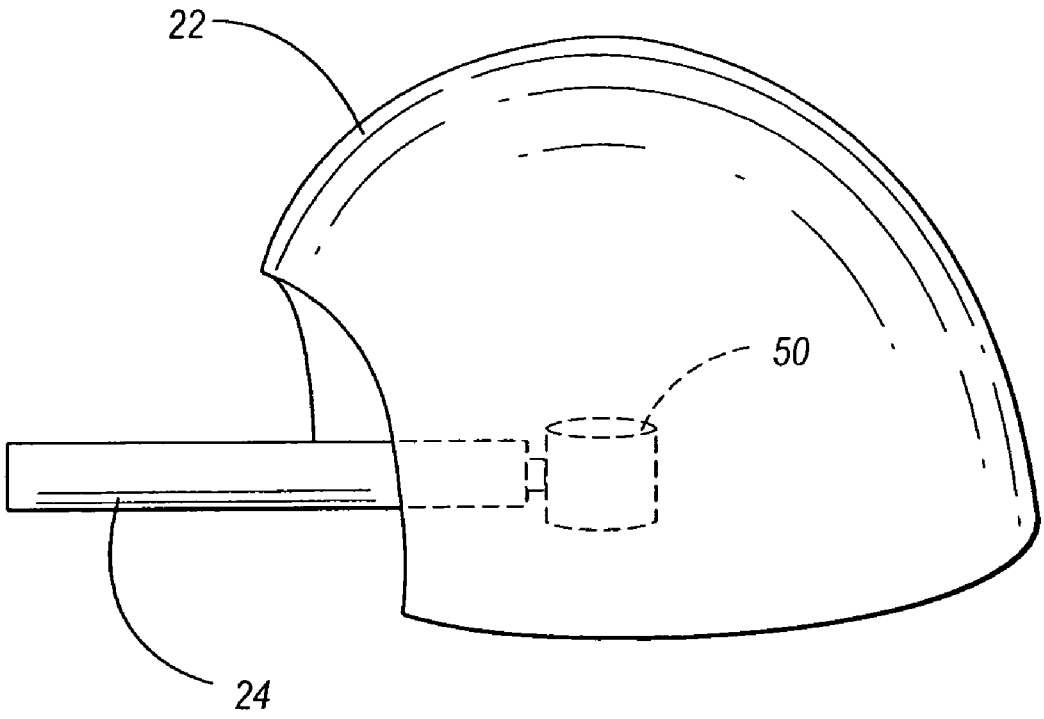
FIG. 11 shows a detailed cut away view of the pivot point and the arm connection shown in FIG. 10.
Figure 12:
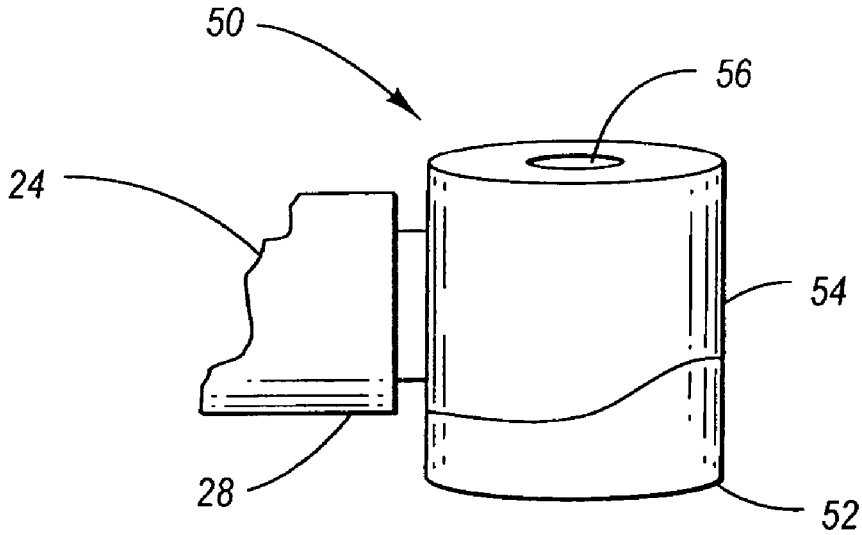
FIG. 12 shows a detailed cut away view of the arm connection device shown in FIG. 11.

In a third preferred embodiment of the invention shown in FIGS. 10-12, the control arm 24 is connected to the underside 16 of the training board 12 by a two piece clamp 50 referred to in some instances as a universal clamp. Such a clamp 50 is made from a first piece 52 that is fixedly connected to the underside 16 of the board 12. A second piece 54, which is compatibly configured to be placed over and to connect with the first piece 52, is then placed on top of the first piece and is interconnected with the control arm 24. A connector 56 holds the two pieces together. In the preferred configuration, the first and second pieces 52, 54 each have a high side and a low side and interact so as to restrict movement of the control arm 24 within a designated arc.

In use, a rider stands on the upper side of the board or deck. As the rider makes various movements, the second end portion 20 of the device 12 pivots upon the dome shaped pivoting mechanism 22. As the second end 20 of the device pivots around this pivot point 22, a wheel 30 that is positioned near the first end 18 of the board between the board and a lower surface, travels between a lower surface and the underside 16 of the board 12 itself.

When weight is placed upon the topside 14 of the training board 12, the board will tip upon the pivot point 22. This tipping will then cause the wheel 30 that is in contact with the underside 16 of the training board 12 to roll. The amplitude and range of the arc in which this wheel 30 will roll is controlled by the movement of the control arm 24, and in some instances, by the stops 38, 38' that are positioned along the margins of the underside 16 of the training board 12 itself. In some embodiments of the invention, the arc in which the wheel 30 will roll may also be controlled solely by the configuration of the control arm 24 and the connection of the control arm 24 with the training board 12.

This configuration provides a variety of advantages to a user. A user while standing on the top 14 of the board 12 can shift his weight to swing the first end 18 of the board 12 in a variety of lateral directions by pivoting the board 12 upon the rear pivot point 22. The weight of the rider causes the first-end 18 of the board to ride over the top of the wheel 30, and for the first end 18 to move both in a vertical as well as in a lateral direction. This simulates the action and movements that a user would have to make to engage in turning a board. To simulate a turn in the opposite direction, the rider would then shift their weight or press their feet in the other direction or on the other side of the board. By repeating these movements the coordination and balance required to control a surfboard, snowboard, skateboard or the like is approximated. In addition to its use as a training device, the present invention may also be used as a recreational device in and of itself as well as a ski training device.

While there is shown and described the present preferred embodiment of the invention, it is to be distinctly understood that this invention is not limited thereto, but may be variously embodied to practice within the scope of the following claims. From the foregoing description, it will be apparent that various changes may be made without departing from the spirit and scope of the invention as defined by the following claims.

I claim:

1. A balance board-training device configured to allow a user to simulate the movements and actions involved in riding and controlling a board utilized in a sport, said balance board-training device comprising:

a training board having an upper side and an underside, a first end portion and a second end portion;

a pivoting device permanently connected to said underside of said training board in a stable non-moving position near said rear portion;

a control arm having a first end connected to said underside of said training board near said second end portion, said control arm extending from said connected first end to a second end; and a wheel, said wheel connected to said second end of said control arm in such a way so as to allow said wheel to roll laterally across said underside of said training board near said first end portion of said training board.

2. The balance board-training device of claim 1, wherein said control arm further comprises a control arm pivot point and a control arm connection device, said control arm connection device configured to connect said control arm to the underside of said training board, said control arm pivot point providing a location and position upon which the control arm pivots in relation to said training board.

3. The balance board of claim 1, wherein said pivoting device is a generally hollow shaped dome.

4. The balance board-training device of claim 1, wherein said pivoting device is hollow and a portion of said control arm extends through said pivoting device.

5. The balance board of claim 1, wherein said pivoting device defines an aperture, said aperture configured to limit the movement of said control arm within a preselected arc.

6. The balance board of claim 1, wherein the arm of said control arm further comprises a connection device, said connection device connected to the underside of said training board by a flexible connection.

7. The balance board of claim 1 further comprising a pair of stops positioned upon said underside of said balance board, said stops configured to prevent the movement of said wheel beyond a preselected path.

8. The balance board of claim 1 further comprising an elastic cord connected to said wheel, said elastic cord configured to pull said wheel back into a generally inline alignment after said wheel has been moved out of said inline alignment.

9. The balance board of claim 1 further comprising a protective track connected to said underside of said board.

10. A balance board-training device configured to allow a user to simulate the movements and actions involved in riding and controlling a board utilized in a typical board sport, said balance board-training device comprising:

a training board having an upper side and an underside, a first end portion and a second end portion;

a pivoting device permanently connected to the underside of said training board in a stable non-moving position near said second end portion; a control arm having a first end connected to said underside of said training board near said second end portion, said control arm extending from said connected first end to a second end; and a rolling device, said rolling device connected to said second end of a control arm in such a way so as to allow said rolling device to roll laterally across said underside of said training board near said first end portion.

11. The balance board of claim 10, wherein said pivoting device is a generally hollow shaped dome made of a hard durable plastic.

12. The balance board of claim 10, wherein said pivoting device defines an aperture, said aperture configured to limit the movement of said control arm within a preselected arc.

13. The balance board-training device of claim 10, wherein said control arm further comprises a control arm pivot point and a control arm connection device, said control arm connection device configured to connect said control arm to the underside of said training board, said control arm pivot point providing a location and position upon which the control arm pivots in relation to said training board.

14. The balance board-training device of claim 13, wherein said pivoting device is hollow and a portion of said control arm extends through said pivoting device.

15. The balance board of claim 14, wherein said control arm further comprises a connection device, said connection device connected to the underside of said training board by a flexible connection.

16. The balance board of claim 10 further comprising a pair of stops positioned upon said underside of said balance board, said stops configured to prevent the movement of a wheel beyond a preselected path.

17. The balance board of claim 10 further comprising an elastic cord connected to said wheel, said elastic cord configured to pull said wheel back into a generally inline alignment after said wheel has been moved out of said inline alignment.

18. The balance board of claim 10, further comprising a protective track connected to said underside of said board.

19. A balance board-training device configured to allow a user to simulate the movements and actions involved in riding and controlling a board utilized in a typical board sport, said balance board-training device comprising:

a training board having an upper side and an underside, a first end portion and a second end portion;

a pivoting device permanently connected to the underside of said training board in a stable non-moving position near said second end portion, said pivoting device being a generally hollow shaped dome made of a hard durable plastic and defining an aperture therein, said aperture configured to control the movement of said control arm within a preselected arc; and a rolling device, said rolling device connected to a control arm in such a way so as to allow said rolling device to roll laterally across said underside of said training board near said first end portion, said control arm further comprising a control arm pivot point and a control arm connection device, said control arm connection device configured to connect said control arm to the underside of said training board through a flexible connection, said control arm pivot point providing a location and position upon which the control arm pivots in relation to said training board, said control arm connected to said underside of said training board so as to allow said control arm to extend through the aperture of said pivoting device, said rolling device also connected to an elastic cord, said elastic cord configured to pull said wheel back into a generally inline alignment after said wheel has been moved out of said inline alignment by movement of a user upon the board.

* * * * *